US007698776B1

(12) United States Patent
Lawson

(10) Patent No.: US 7,698,776 B1
(45) Date of Patent: Apr. 20, 2010

(54) BALANCED CLEANING APPARATUS

(76) Inventor: John H. Lawson, 9024 Hardesty Dr., Clinton, MD (US) 20735

( * ) Notice: Subject to any disclaimer, the term of this patent is extended or adjusted under 35 U.S.C. 154(b) by 1024 days.

(21) Appl. No.: 11/416,265

(22) Filed: May 1, 2006

(51) Int. Cl.
*A47L 13/50* (2006.01)

(52) U.S. Cl. ..... 15/257.7; 15/257.1; 15/257.2; 15/104.8

(58) Field of Classification Search ..... 15/104.8, 15/257.1, 257.2, 257.7
See application file for complete search history.

(56) References Cited

U.S. PATENT DOCUMENTS 4,148,513 A * 4/1979 Gagne ..... 294/1.4
2005/0071943 A1* 4/2005 Liu ..... 15/257.2

* cited by examiner

*Primary Examiner*—Shay L Karls

(57) ABSTRACT

A balanced cleaning apparatus that advantageously contains a carrying handle, a dust pan and a bucket wherein the dustpan and the bucket are carried at the two ends of the carrying handle in a balanced position.

9 Claims, 3 Drawing Sheets

BALANCED CLEANING APPARATUS

FIELD OF THE INVENTION

The present invention generally relates to a cleaning apparatus and more particularly, relates to a balanced cleaning apparatus wherein an open top container and a dustpan are each attached to one end of a carrying handle in a balanced condition.

BACKGROUND OF THE INVENTION

In the cleaning or janitorial service for either homes or offices, a bucket, a dustpan, and a broom are the most frequently used cleaning tools. The bucket is normally used for containing a cleaning solution, or to hold refuse material, while the dustpan is used to sweep up refuse material from the floor. In order to carry out an efficient cleaning operation, a person must carry the dustpan, the bucket in each one of his two hands which makes it awkward to carry any other cleaning tool, such as a broom. While a cleaning cart, or a wheeled cart can be used to hold all the cleaning tools and utensils, it is expensive and bulky and cannot be easily transported up or down the stairs.

It is desirable to provide a cleaning apparatus that can be used to easily carry several cleaning tools or utensils at the same time without occupying both hands of a cleaning person.

It is therefore an object of the present invention to provide a balanced cleaning apparatus which does not have the drawbacks or shortcomings of the conventional cleaning tools.

It is another object of the present invention to provide a balanced cleaning apparatus wherein a carrying handle is used to carry and transport at least two cleaning tools single-handedly by a cleaning person.

It is another further object of the present to provide a balanced cleaning apparatus wherein a carrying handle is used to carry both a bucket and a dustpan by a cleaning person in one hand.

It is still another object of the present invention to provide a balanced cleaning apparatus wherein a cleaning person can carry a bucket and a dustpan in one hand, while still able to carry a broom in the other hand.

SUMMARY OF THE INVENTION

In accordance with the present invention, a balanced cleaning apparatus which can be used to carry both a bucket and a dustpan in one hand of a cleaning person is provided.

In a preferred embodiment, the balanced cleaning apparatus is constructed of an elongated first handle that has a center grip section, a first end with a horizontally projecting pin and a second end with a notch in a top surface; a dustpan that has a second handle equipped with a plurality of apertures vertically disposed each for frictionally engaging the horizontally projecting pins on the elongated first handle; and an open-top container equipped with a third handle for receiving by the notch in the top surface of the first handle.

BRIEF DESCRIPTIONS OF THE DRAWINGS

The invention will now be described, by way of example, with reference to the accompanying drawings, in which.

DETAILED DESCRIPTIONS OF THE PREFERRED EMBODIMENT

Figure 1:
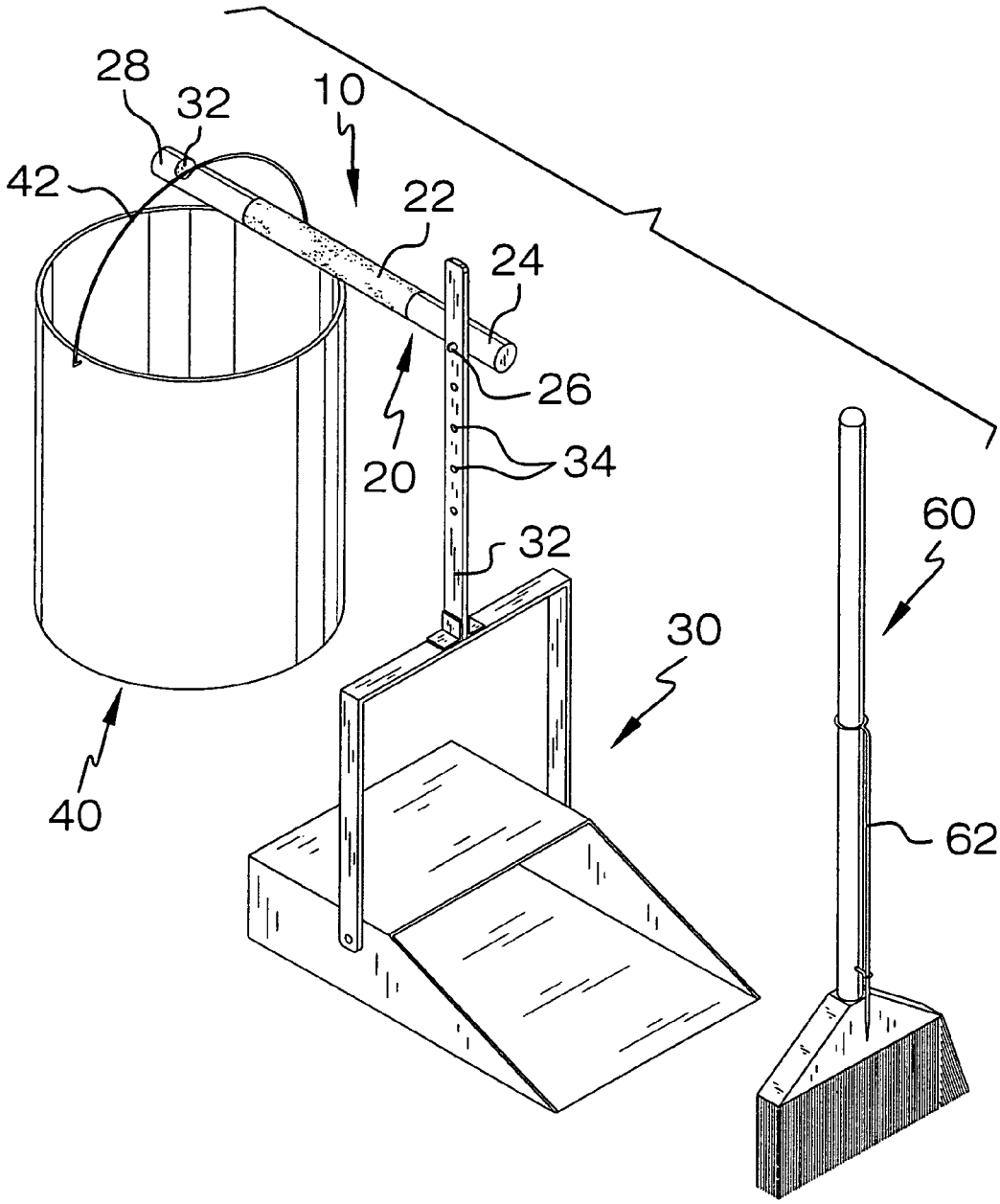
FIG. 1 is a perspective view of the present invention balanced cleaning apparatus shown with a broom.

The present invention discloses a balanced cleaning apparatus which consists of a carrying handle, a bucket, and a dustpan wherein the bucket and the dustpan are carried by the handle in a balanced condition.

The present invention balanced cleaning apparatus is a specially designed handle that combines a dustpan and a bucket, such as a five-gallon bucket, for the purpose of refuse pick-up. The apparatus can be used for both home cleaning and by professional janitors and cleaning personel.

The balanced cleaning apparatus consists of a lightweight handle that has a rubber comfort grip for ease in handling. The handle is placed in a horizontal position. On one end of the handle, a dustpan is attached, while on the other end of the handle, a refuse bucket can be attached. The dustpan can further be connected to its own handle with height adjustment apertures incorporated into its design. The handle can be easily snapped onto any hole. The opposite end of the handle features a slight indentation, or notch, to accept the handle of the bucket.

A separate broom can also be provided as part of the present invention balanced cleaning apparatus. The broom measures about thirty-six inches long, and has angled bristles for cleaning hard-to-reach corners, as well as a five-inch spike for lawn pick-up. The balanced cleaning apparatus advantageously balance a dustpan and a trash bucket to eliminate the continuous pushing of a large trash can. The user can easily empty the trash from the dustpan into a five-gallon bucket. The carrying handling measures nineteen inches long and about one and a quarter inches wide. The handle can be produced from aluminum or wood and in a wide range of colors and styles.

The present invention balanced cleaning apparatus fulfills the need for a time saving means of gathering and disposing trash both indoors and outdoors. The appealing features of the balanced cleaning apparatus is its times savings, energy-savings, convenience, efficiency, practicality, durability, effectiveness, novel design, and ease of operation. The carrying handle can be used to balance a dustpan and a refuse bucket for use when picking up refuse. A person would not need to constantly push a garbage can from area to area while picking up trash indoors and outdoors. The dustpan and the bucket can be used in conjunction with a specially designed broom.

The present invention balanced cleaning apparatus effectively reduce physical exertion while cleaning, which saves janitors and cleaning personel a considerable amount of time and energy in carrying out their cleaning task.

The present invention carrying handle contributes to greater efficiency and better performance while cleaning. The balanced cleaning apparatus serves as an efficient alternative to conventional dustpans and brooms. The refuse bucket can be immediately available to deposit the refuse. The carrying handle therefore allows an individual to collect dirt, dust, and debris from floors and lawns in an efficient timesavings and effortless manor. The carrying handle is simple to use, convenient, lightweight, adjustable, timesaving, efficient, novel, practical, handy, and durable for years of effective use. The balanced cleaning apparatus can be used by janitorial services, maintenance crews and housekeepers to maintain either commercial or home facilities.

Referring initially to FIG. 1, wherein a present invention balanced cleaning apparatus 10 is shown. The balanced cleaning apparatus 10 includes an elongated first handle 20 which has a center grip section 22, a first end 24 that has a horizontally projecting pin 26 (FIG. 3), and a second end 28 which has a notch 32 in a top surface of the carrying handle 20.

The present invention balanced cleaning apparatus 10 further includes a dustpan 30 which has a second handle 32 equipped with a plurality of apertures 34 that are vertically disposed along the handle 32. Each of the plurality of apertures 34 may engage the horizontally projecting pin 26 provided on the carrying handle 20.

The present invention balanced cleaning apparatus 10 further includes an open-top container 40 that is equipped with a third handle 42 for receiving by the notch 32 in the top surface of the carrying handle 20.

FIG. 1 further illustrates a broom 60 that may be optionally a part of the present invention balanced cleaning apparatus 10. The broom 60 is further equipped with a slidible spike 62 which can be used, when extended downwardly, to pick up lawn debris.

Figure 2:
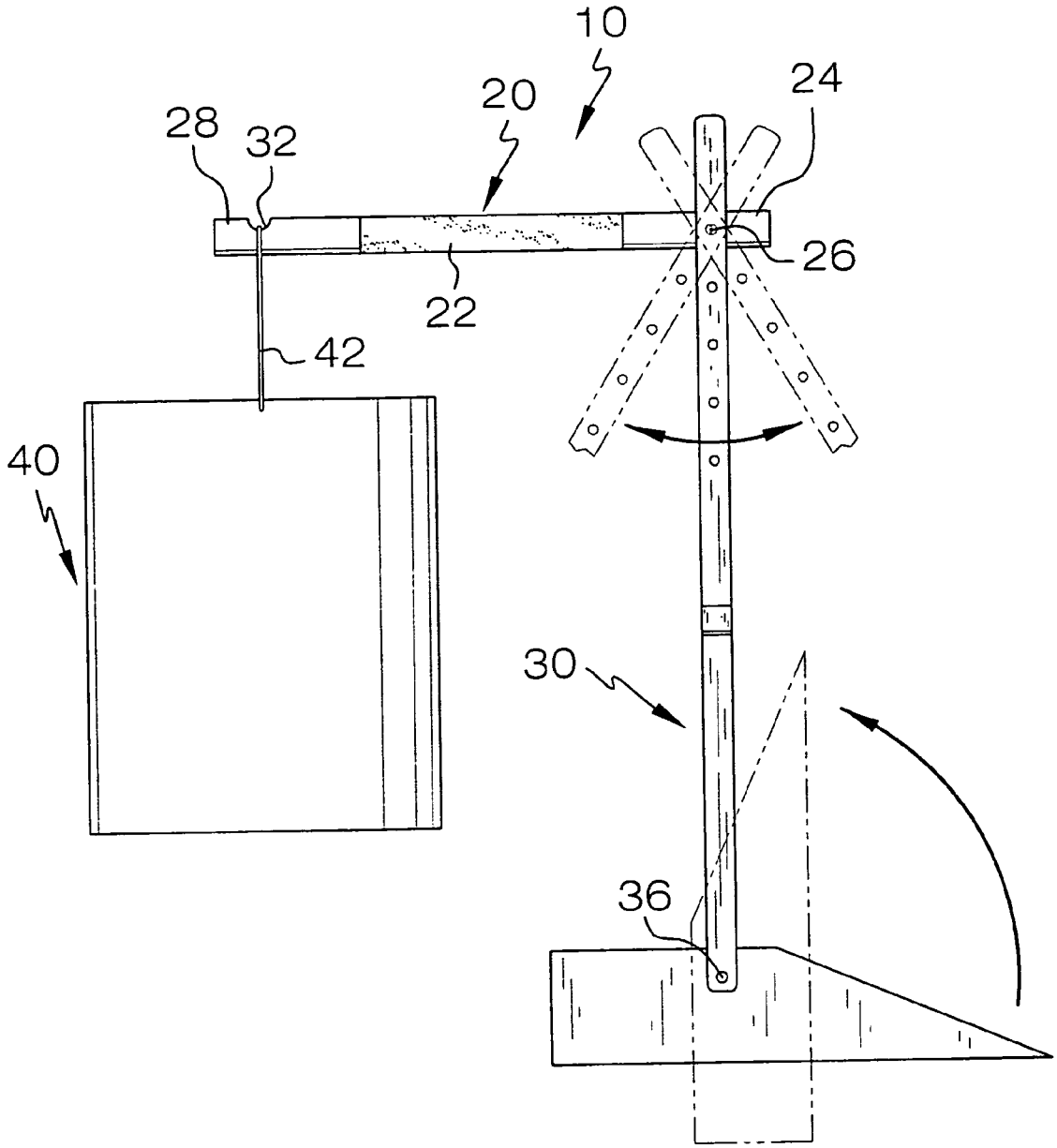
FIG. 2 is a side view of the present invention balanced cleaning apparatus illustrating the dustpan in various positions.

The operation of the present invention balanced cleaning apparatus 10 is shown in FIG. 2, in a side view. It is seen that the dustpan 30 is mounted on a carrying handle 20 through the aperture 34 by snapping onto the horizontal pin 26. The dustpan 30 may pivot on the pivot point 36 such that it is either in a vertical position when carried (shown in ghost lines in FIG. 2) or in a horizontal position when used to pick up refuse.

The center grip portion 22 of the carrying handle 20 may be suitably coated of a high frictional material, such as rubber.

Figure 3:
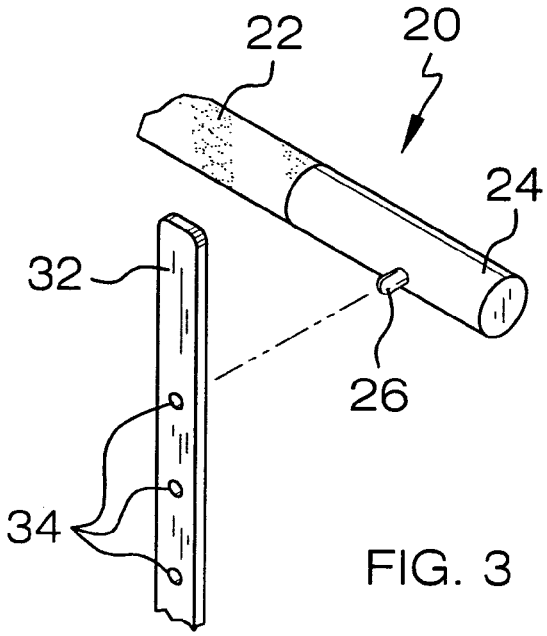
FIG. 3 is a partial, perspective view of the carrying handle and the handle for the dustpan.

The mounting of the present invention dustpan 30 onto the horizontal pin 26 of the carrying handle 20 is further shown in FIG. 3 in a partial, perspective view.

Figure 4:
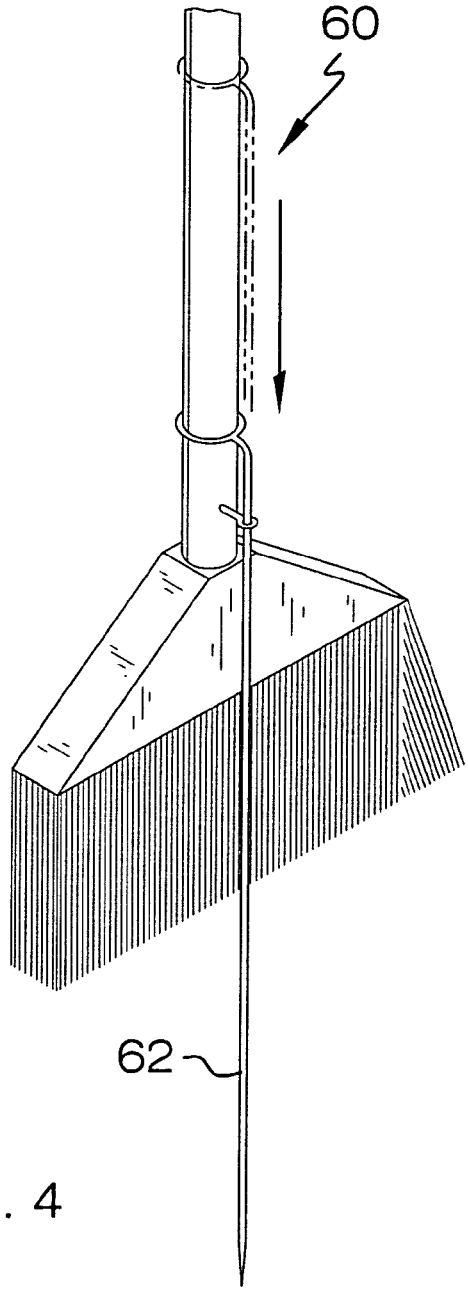
FIG. 4 is a partial, perspective view of the broom equipped with a sliding spike.

A detailed, partial perspective view of the optional broom 60 is further shown in FIG. 4. The slidible retractable spike 62 can be extended when the broom is used in the yard for picking up lawn debris by the spike 62.

The present invention balanced cleaning apparatus has therefore been amply described in the above descriptions and in the appended drawings of FIGS. 1-4.

While the preferred embodiments of the invention have been described above, it will be recognized and understood that various modifications can be made in the invention and the appended claims are intended to cover all such modifications which may fall within the spirit and scope of the invention.

What is claimed is:

1. A balanced cleaning apparatus comprising:

an elongated first handle having a center grip section, a first end with a horizontally projecting pin in the transverse direction of said elongated first handle and a second end with a notch in a top surface;

a dustpan having a second handle equipped with a plurality of apertures vertically disposed each for engaging said horizontally projecting pin on said elongated first handle; and an open-top container equipped with a third handle for receiving by said notch in said top surface of the first handle.

2. The balanced cleaning apparatus according to claim 1, wherein said center grip section of the elongated first handle is coated with a rubber coating.

3. The balanced cleaning apparatus according to claim 1, wherein said horizontally projecting pin has a minimum diameter of one eight of an inch.

4. The balanced cleaning apparatus according to claim 1 further comprising a broom.

5. The balanced cleaning apparatus according to claim 1, wherein said plurality of apertures is at least five apertures.

6. The balanced cleaning apparatus according to claim 1, wherein said elongated first handle is at least fifteen inches long.

7. The balanced cleaning apparatus according to claim 1, wherein said elongated first handle is fabricated of wood.

8. The balanced cleaning apparatus according to claim 1, wherein said elongated first handle is fabricated of plastic.

9. A balanced cleaning apparatus comprising:

an elongated first handle having a center grip section, a first end with a horizontally projecting pin in the transverse direction of said elongated first handle and a second end with a notch in a top surface;

a dustpan having a second handle equipped with a plurality of apertures vertically disposed each for engaging said horizontally projecting pin on said elongated first handle; and an open-top container equipped with a third handle for receiving by said notch in said top surface of the first handle; and a broom equipped with a slidible spike for picking up debris.

* * * * *